US007621572B2

(12) United States Patent
Omdoll et al.

(10) Patent No.: US 7,621,572 B2
(45) Date of Patent: Nov. 24, 2009

(54) SCOOP AND SHEATH

(75) Inventors: Paul Omdoll, Waukesha, WI (US); Michael Young, Mukwanago, WI (US); Nisha Gupta, Waukesha, WI (US); Jayson Peal, Shorewood, WI (US); Christopher Davis, West Bend, WI (US)

(73) Assignee: The Colman Group, Inc., Elkhorn, WI (US)

( * ) Notice: Subject to any disclaimer, the term of this patent is extended or adjusted under 35 U.S.C. 154(b) by 0 days.

(21) Appl. No.: 10/945,688

(22) Filed: Sep. 21, 2004

(65) Prior Publication Data

US 2005/0151384 A1 Jul. 14, 2005

Related U.S. Application Data

(63) Continuation-in-part of application No. 29/189,042, filed on Aug. 27, 2003, now Pat. No. Des. 496,233.

(51) Int. Cl.
*A47F 13/08* (2006.01)

(52) U.S. Cl. ..... 294/55

(58) Field of Classification Search ..... 294/55, 294/51; 172/375, 381; D7/691; D8/10
See application file for complete search history.

(56) References Cited

U.S. PATENT DOCUMENTS 132,134 A * 10/1872 Bowers ..... 294/55
203,885 A * 5/1878 Buttons ..... 294/55
206,011 A * 7/1878 Freeman ..... 294/55
212,678 A * 2/1879 Freeman ..... 294/55
217,528 A * 7/1879 Gourley ..... 294/55
238,308 A * 3/1881 Phillips ..... 294/55
1,711,566 A 5/1929 Jacobs
1,728,858 A 9/1929 Dreher
2,618,501 A 11/1952 Tallant
3,163,170 A * 12/1964 Gates ..... 294/55
3,840,261 A * 10/1974 Fulkerson et al. ..... 294/55
D254,705 S * 4/1980 Whiteside ..... D7/691
D283,196 S * 4/1986 Hasse ..... D8/10
D301,930 S * 6/1989 Cantu ..... D99/34
D438,979 S * 3/2001 Gomes et al. ..... D7/691
6,612,379 B1 * 9/2003 Timmons ..... 294/55
D496,233 S * 9/2004 Young et al. ..... D7/691

FOREIGN PATENT DOCUMENTS

GB 2418134 * 3/2006

OTHER PUBLICATIONS

UK Intellectual Property Office Examination Report Under Section 18(3), Application No. GB0519217.4.

* cited by examiner

*Primary Examiner*—Paul T Chin
(74) *Attorney, Agent, or Firm*—Boyle Fredrickson, S.C.

(57) ABSTRACT

The present invention comprises a scoop having an angled or tapered front shovel portion, a shaped back support, an angled handle attached to the back support and a hand guard. A sheath to hold the scoop when not in use is also preferably provided.

15 Claims, 13 Drawing Sheets

SCOOP AND SHEATH

This application is a continuation-in-part of copending application 29/189,042 file Aug. 27, 2003 to be issued as U.S. Pat. No. D496233.

FIELD OF THE INVENTION

This invention relates generally to devices for moving materials and more particularly to scoops for picking up and transferring ice or the like.

BACKGROUND OF THE INVENTION

Scoops are widely used to transfer materials from one container to another. Typically, a scoop is used to transfer food, ice or other free flowing materials from a larger vessel to a smaller vessel, e.g., from a main storage bin to a bucket or dispenser. However, most scoops used in this process are not ergonomically designed, permit contamination from or to the hand of the user, inefficiently transfer the scooped material resulting in spillage and don't maximize the volume of material conveyed per scoop.

As can be seen, the current scoops suffer from certain drawbacks and limitations. Accordingly, a need exists for scoops that are ergonomically designed, prevent contamination from or to the hand of the user, efficiently transfer the scooped material to minimize spillage and maximize the volume of material conveyed per scoop, and solve other problems associated with the existing designs.

SUMMARY OF THE INVENTION

The present invention comprises a scoop having an angled or tapered front shovel portion, a shaped back support, an angled handle attached to the back support and a hand guard. A sheath to hold the scoop when not in use is also preferably provided.

The angled front shovel portion is tapered from its back to its front in a funnel like manner to permit easier scooping and more efficient and precise product transfer, particularly when material is to be transferred to a container with a narrow mouth. The shaped back support provides a surface against which scooped material can be held. By extending the back support above the sides of the shovel portion of the scoop, more material can be held by the scoop. A small "step" may be provided in the shaped back to improve material retention as well as enhancing the strength of the scoop itself. The handle is preferably attached to the back support at an angle. This angle permits a user to hold material during the transfer process at a more comfortable position without spillage. The point of attachment of the handle to the back support is preferably coincident with the vertical position of the center of gravity of the scoop, above the bottom of the shovel portion, when the shovel portion is filled with material. This placement improves material handling generally and specifically improves the ability of a user to comfortably scoop and hold a large amount of material.

Preferably, a hand guard is provided below the handle to prevent a user's hand from coming into contact with the material being transferred. This is extremely useful where the material itself is harmful when touched or to avoid the contamination of things such as food products.

When appropriate, the present invention also includes a sheath for holding the scoop in a secure, isolated condition. A full sheath, such as those depicted herein, isolates the scoop from the environment thereby preventing contamination from or to the air or other source (e.g., people). The sheath may be configured to force a particular orientation of the scoop for storage purposes. It may also include or interact with a mounting bracket or the like.

These and other objects and advantages of the present invention will become apparent from the detailed description, claims, and accompanying drawings.

DETAILED DESCRIPTION OF THE PREFERRED EMBODIMENTS

Figure 1:
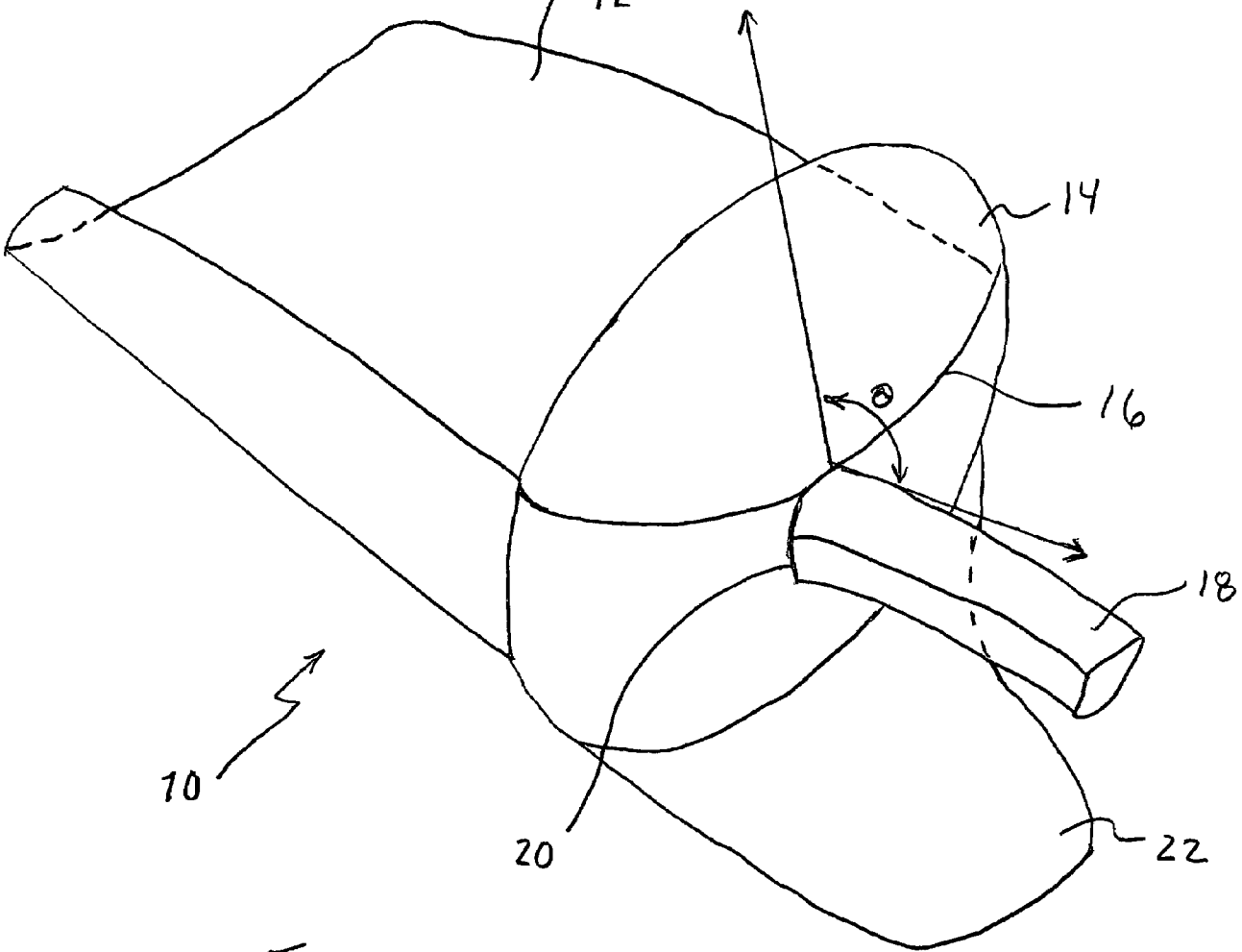
FIG. 1 is a top rear perspective view of a scoop in accordance with one embodiment of the present invention.
Figure 2:
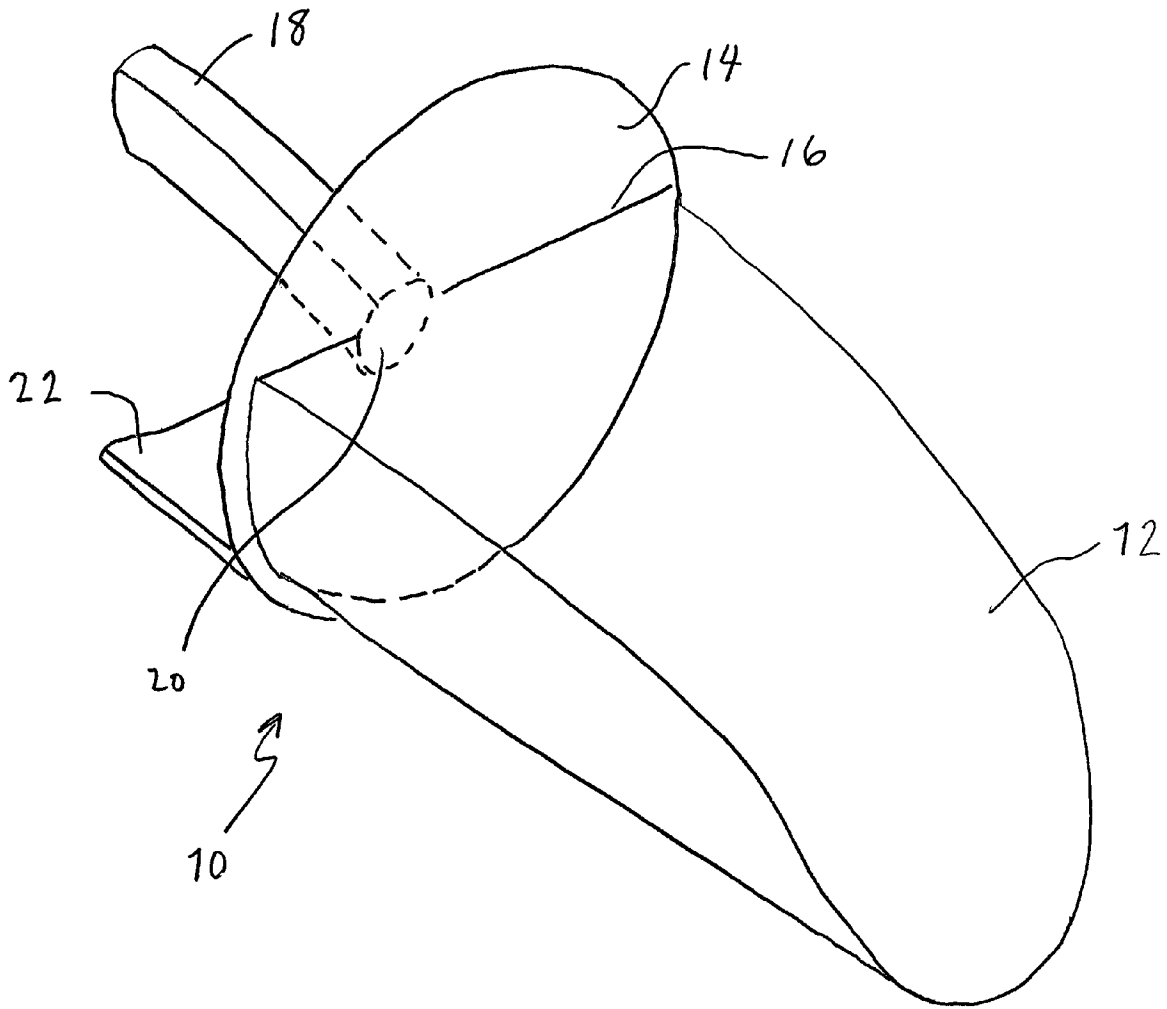
FIG. 2 is a top front perspective view of the scoop of FIG. 1.
Figure 3:
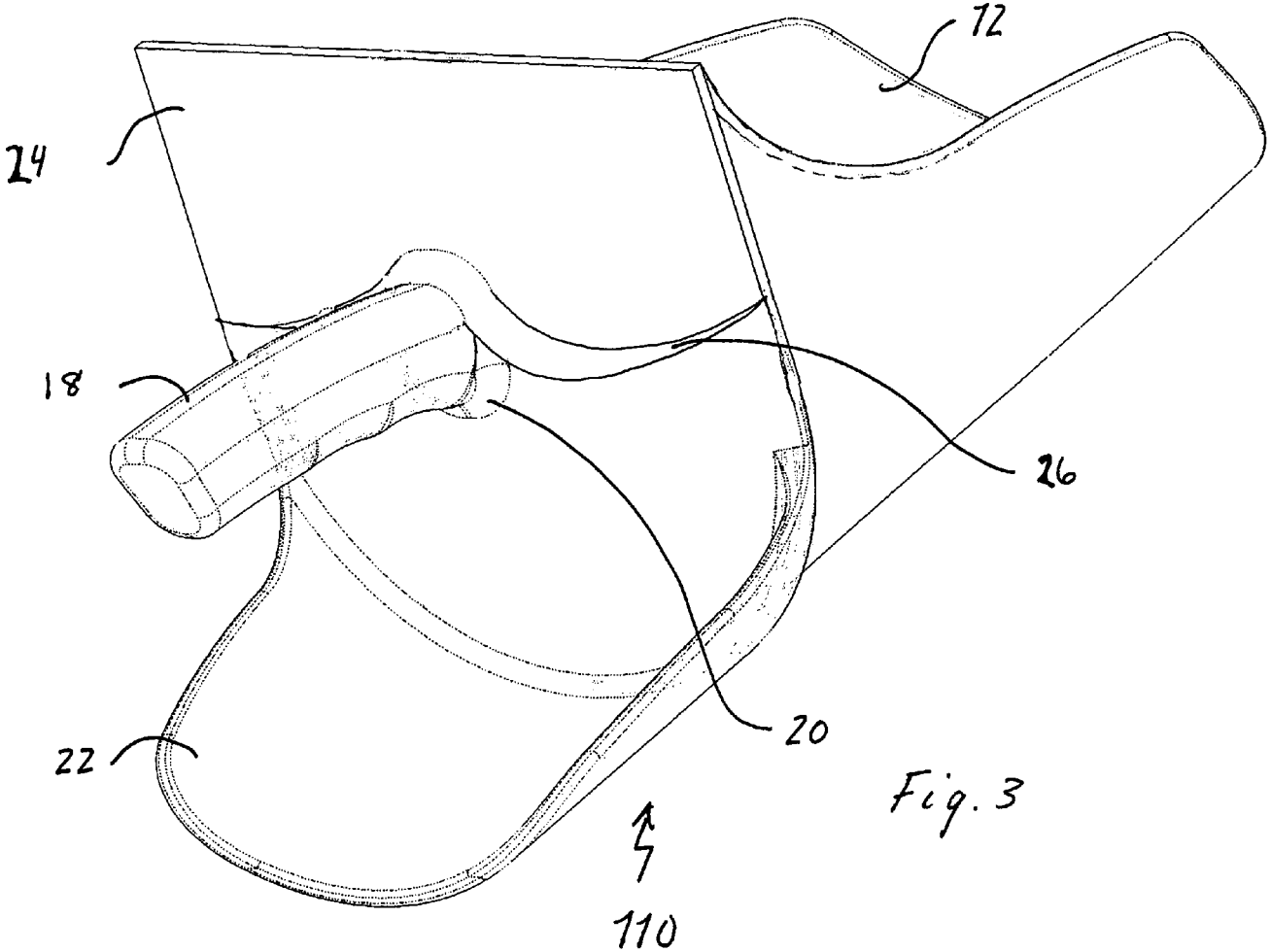
FIG. 3 is a perspective view of a scoop in accordance with a second embodiment of the present invention.
Figure 4:
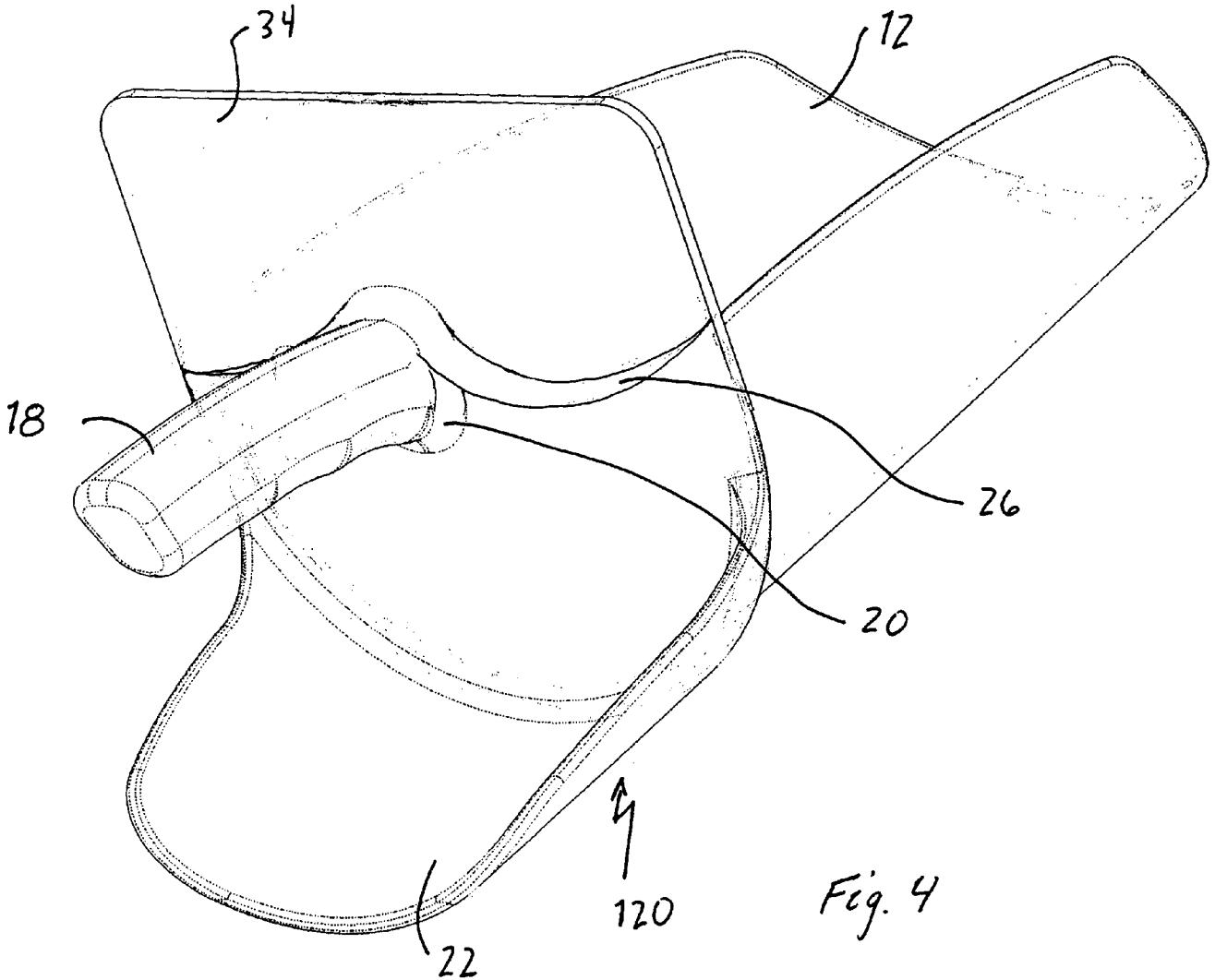
FIG. 4 is a perspective view of a scoop in accordance with a third embodiment of the present invention.
Figure 5:
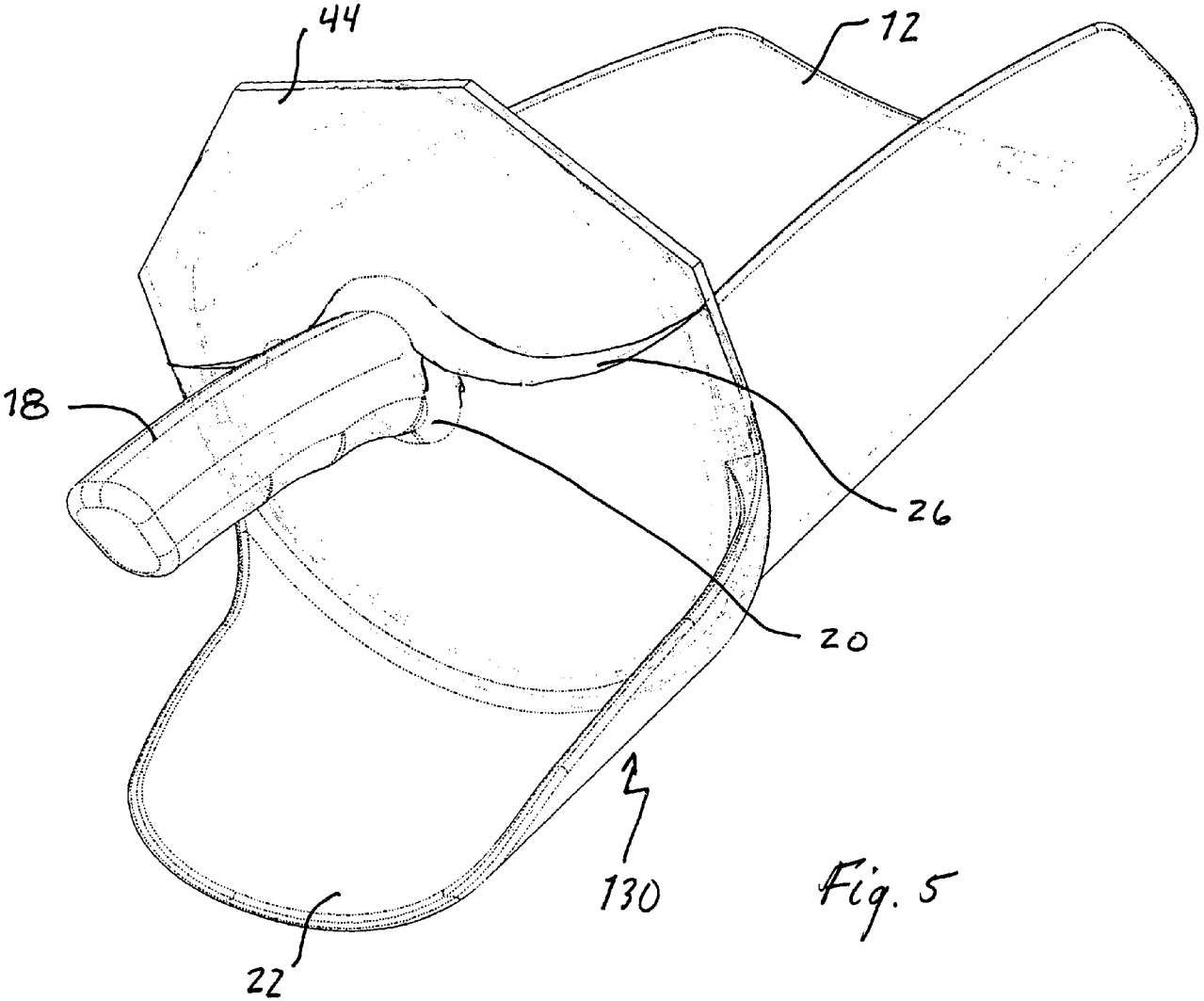
FIG. 5 is a perspective view of a scoop in accordance with a fourth embodiment of the present invention.
Figure 6:
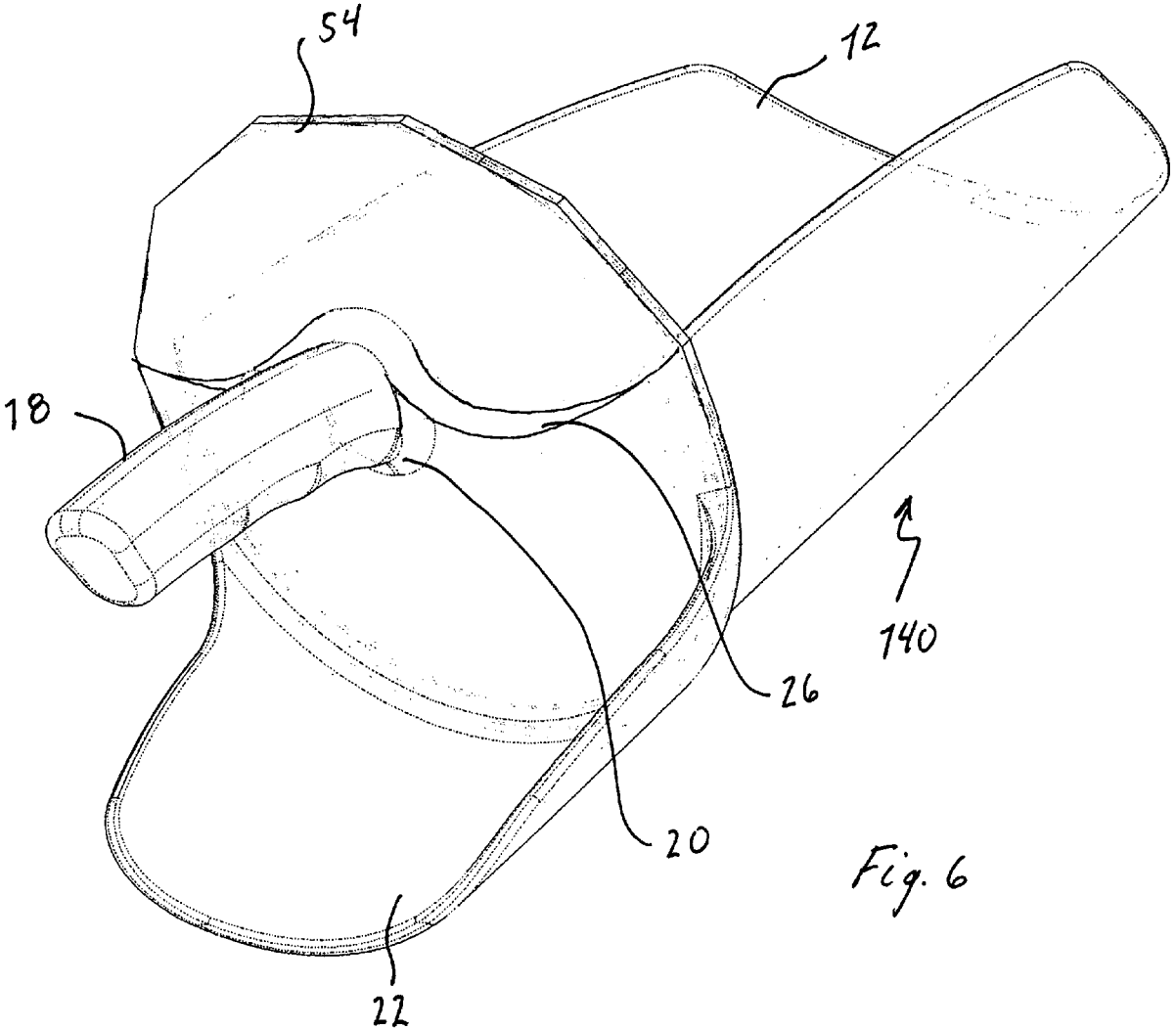
FIG. 6 is a perspective view of a scoop in accordance with a fifth embodiment of the present invention.
Figure 7:
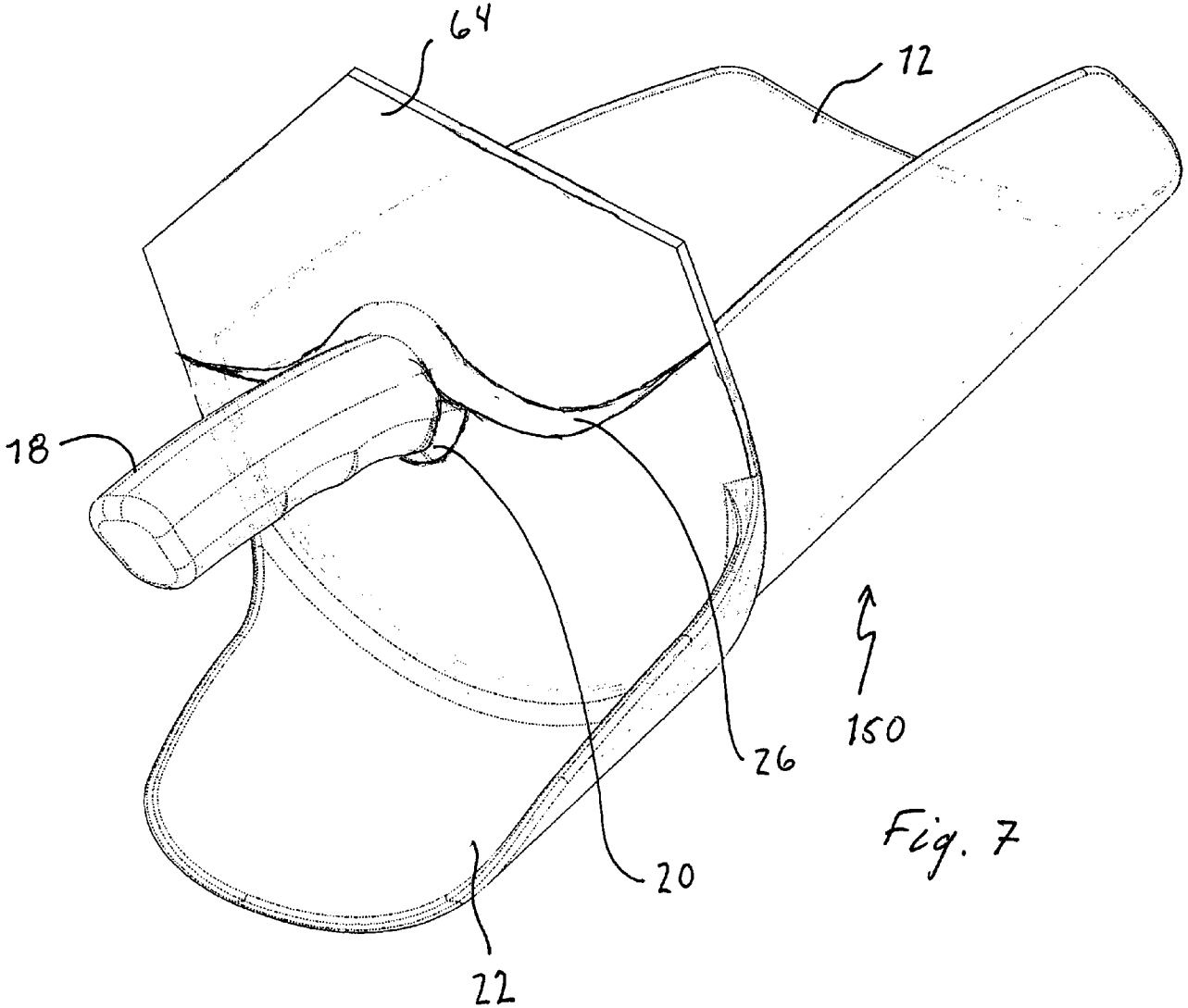
FIG. 7 is a perspective view of a scoop in accordance with a sixth embodiment of the present invention.
Figure 8:
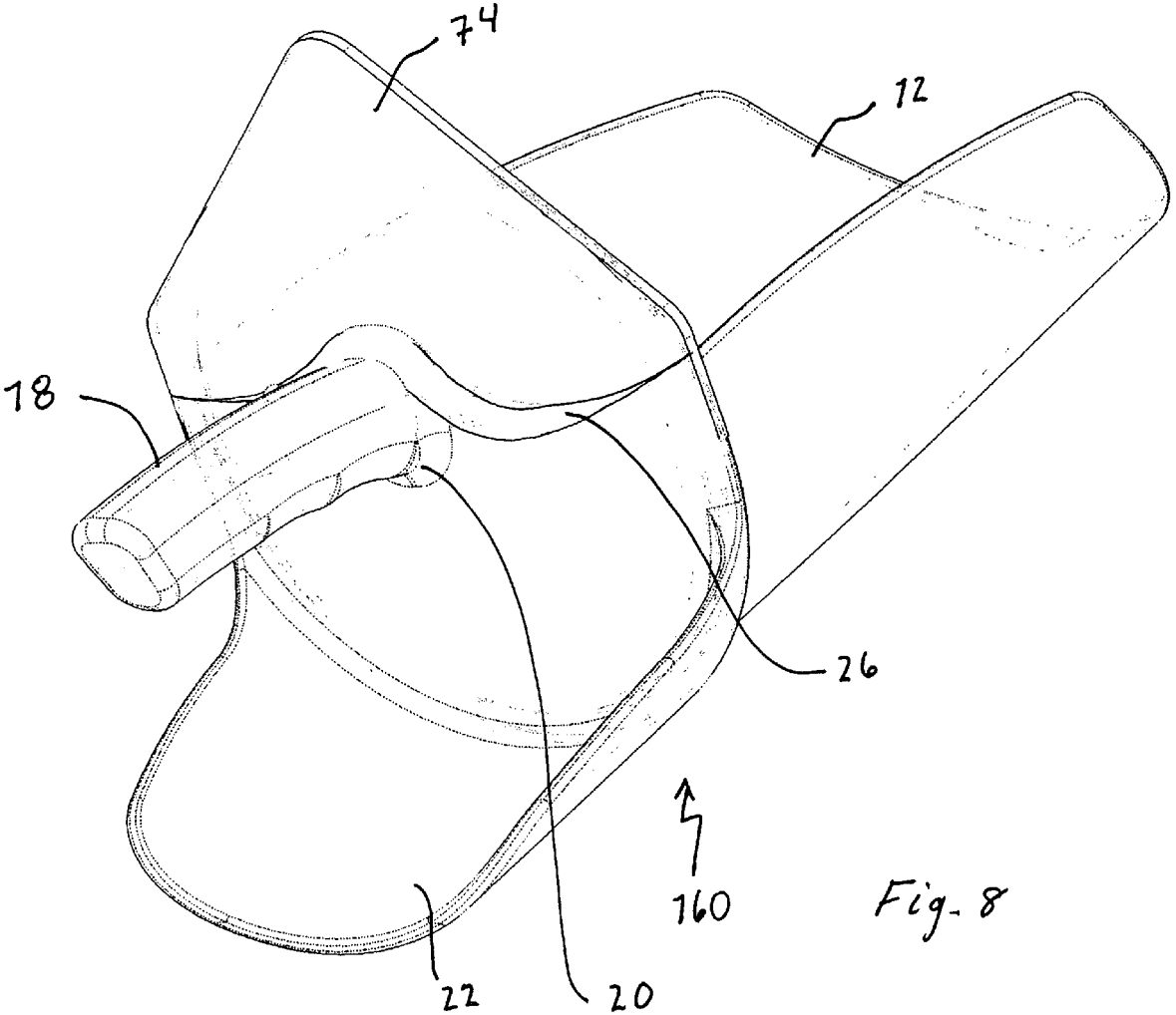
FIG. 8 is a perspective view of a scoop in accordance with a seventh embodiment of the present invention.

As shown in FIGS. 1 and 12-14, the present invention comprises a scoop 10 having an angled front shovel portion 12, a shaped back support 14, an angled handle 18 attached to the back support 14 and a hand guard 22. A sheath 26, as shown in FIGS. 9-12 and 15, to hold the scoop 10 when not in use is also preferably provided.

As shown most clearly in FIGS. 1, 2, 12 and 13, the shovel portion 12 is angled or tapered towards its front end, away from the back support 14, to create a slight funnel or conical shape. As a result, the front end of the shovel portion 12 is narrower than the back of the shovel portion 12 where it meets the back support 14. Preferably the ratio between the width of the shovel portion 12 from where it meets the back support 14 to the front end of the shovel portion is approximately 4.5:1, more preferably approximately 2:1 and most preferably approximately 1.4:1.

The back support 14 forms the base or back of shovel portion 12. It functions as a backstop and hand guard when the scoop 10 is used. Preferably a step 16 is provided in back support 14 to give the support 14 added strength and to increase the carrying capacity and stability of the scoop 10 when it is filled with material.

The handle 18 is connected to, or otherwise integral with, back support 14 at a location 20. This location is preferably coincident with the center of gravity of the scoop 10 (vertically above the bottom of the shovel portion 12) when the scoop 10 is filled with material. The handle 18 is also preferably angled with respect to the back portion 14 such that the angle θ, as shown in FIG. 1, is less than 90°. As seen more clearly in FIG. 13, the angle α of the handle to the back support 14, is preferably between 1 and 30°, more preferably between 5 and 15° and most preferably between 8 and 9°.

Most preferably, a hand guard 22, extending from the bottom of the back support 14, is provided below the handle 18. The hand guard 22 is spaced and angled so as to permit easy grasping of the scoop 10 by a user.

The scoop of the present invention can also be constructed with a variety of shapes of its back portion without compromising its functionality. By way of example, FIGS. 3-8 show various embodiments of the scoop designated respectively as 110, 120, 130, 140, 150 and 160, with slightly modified back portions, 24, 34, 44, 54, 64 and 74.

Figure 9:
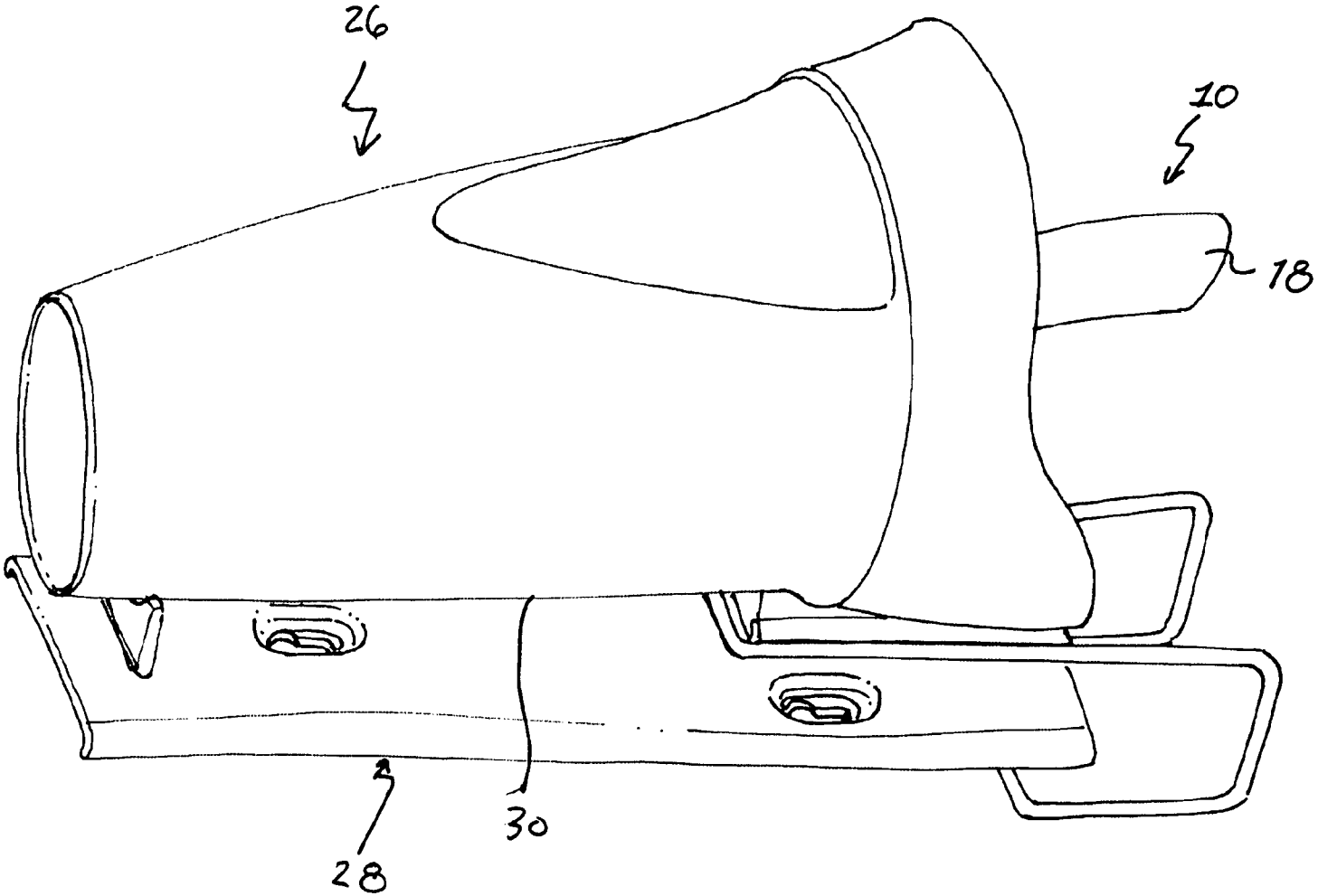
FIG. 9 is a front side perspective view of a scoop shown in a sheath with a mounting bracket in accordance with one embodiment of the present invention.
Figure 10:
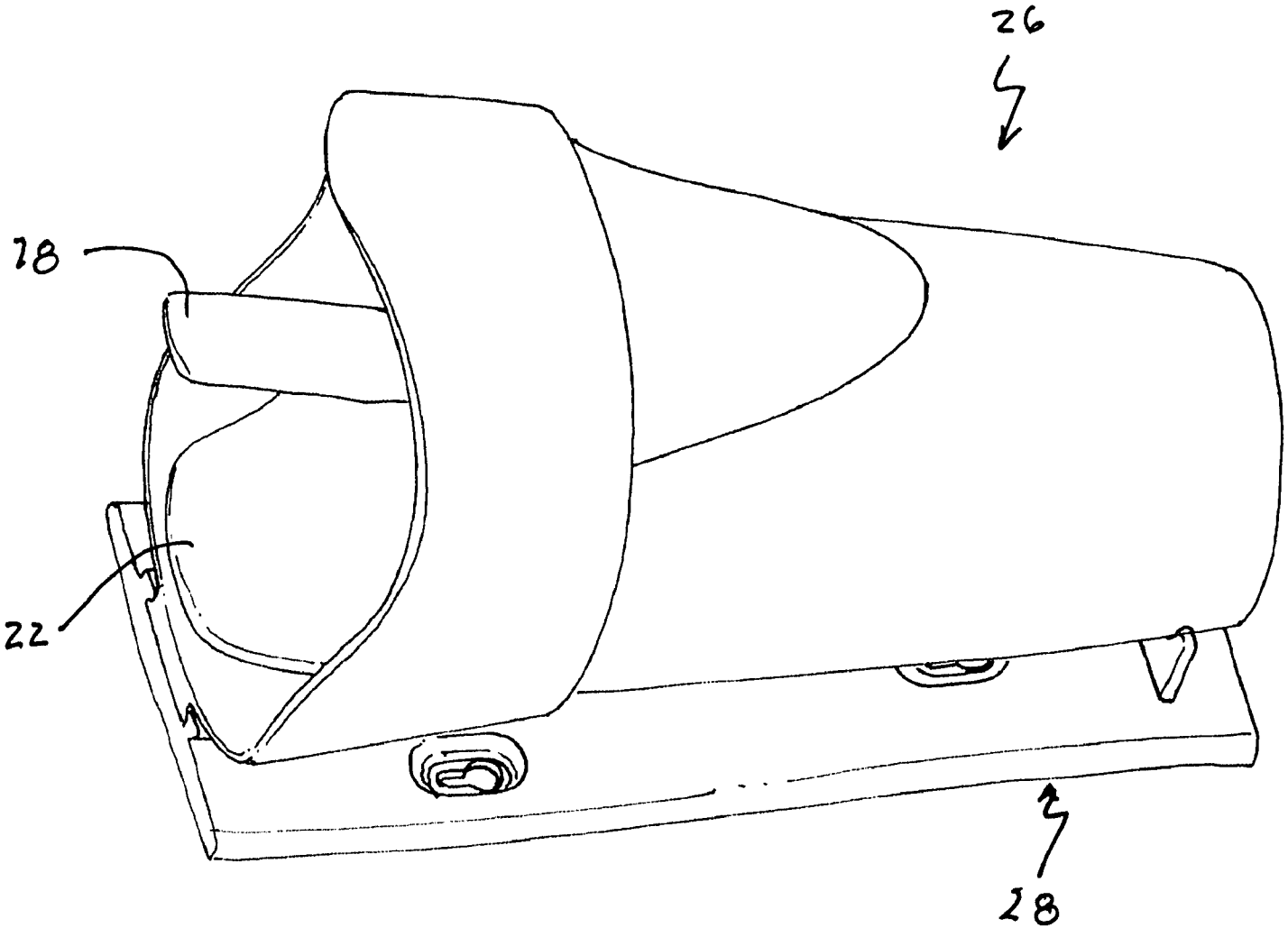
FIG. 10 is a rear side perspective view of the scoop and sheath of FIG. 9.
Figure 11:
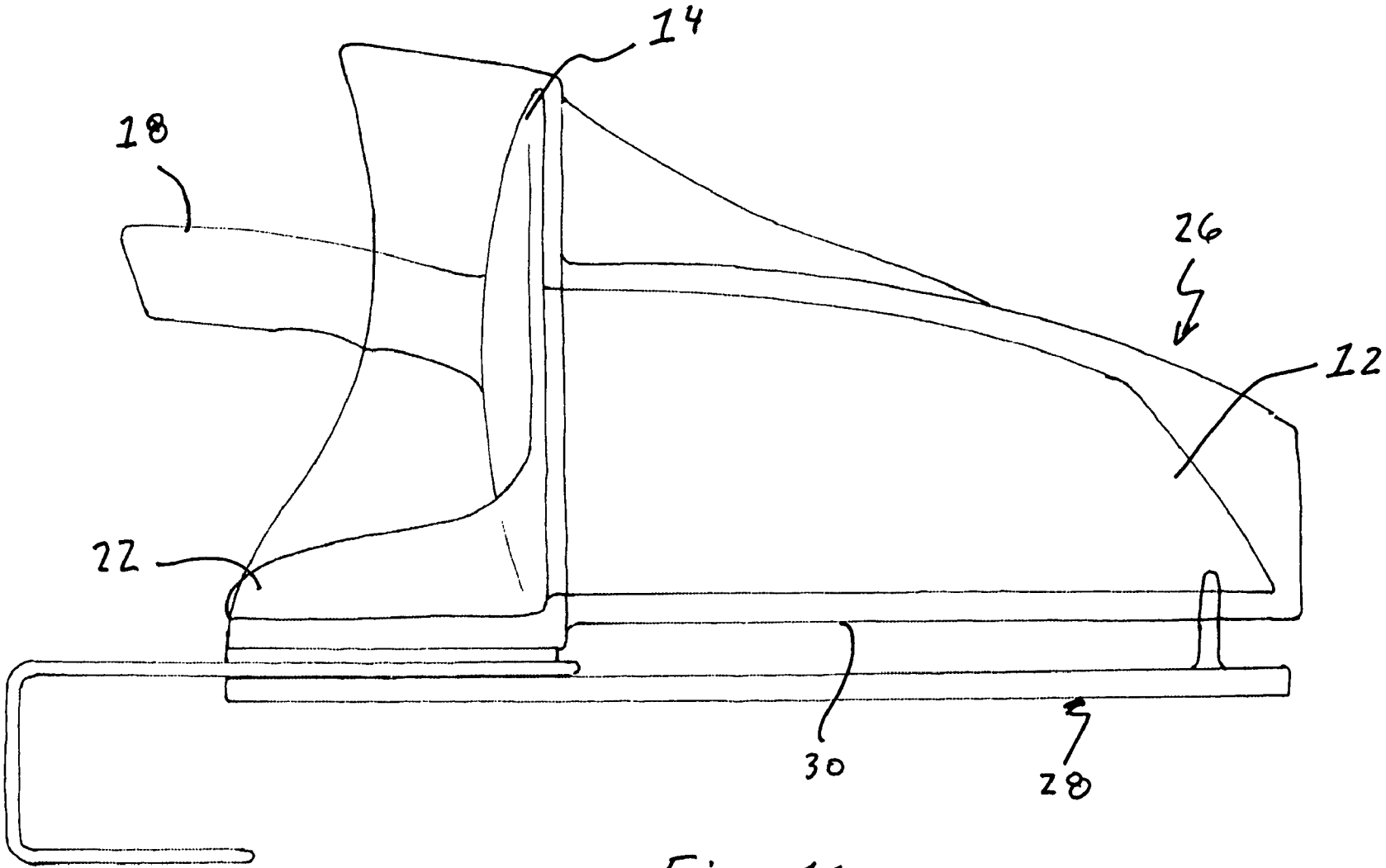
FIG. 11 is a side cross-sectional view of the scoop and sheath of FIG. 9.
Figure 14:
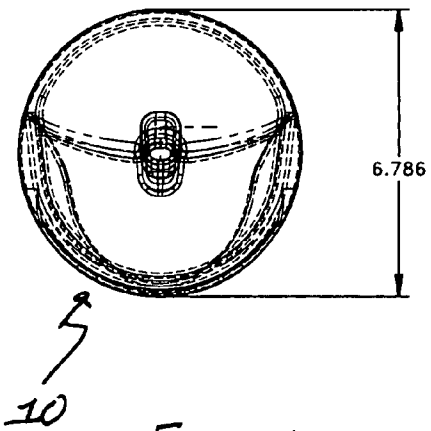
FIG. 14 is a front view of the scoop of FIG. 1.
Figure 12:
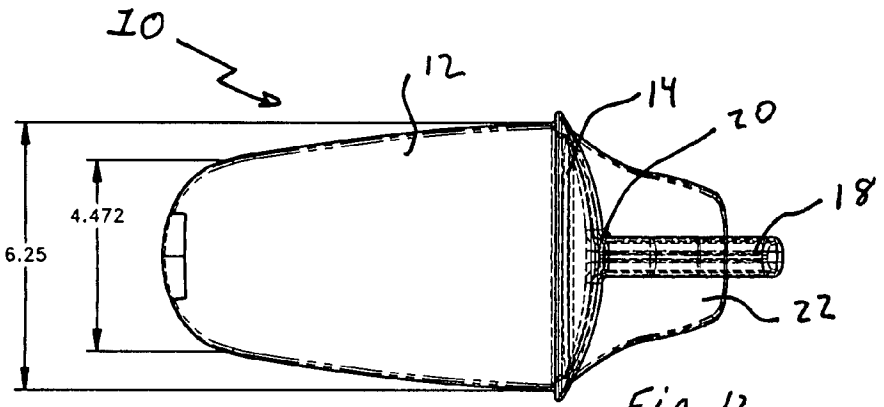
FIG. 12 is a top plan view of the scoop of FIG. 1.
Figure 13:
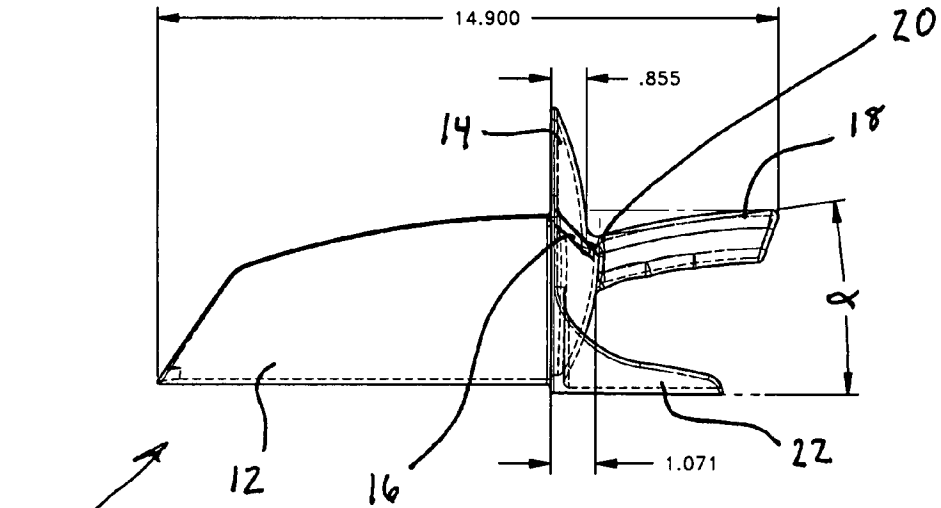
FIG. 13 is a side view of the scoop of FIG. 1.

FIGS. 9-11 show the scoop of the present invention resting in sheath 26 that is, in turn, attached to a bracket 28. The sheath 26 is preferably constructed so as to mimic the funnel or conical shape of the shovel portion 12. This use of this shape, as opposed to, for example, a substantially cylindrical shape as shown in FIG. 15, minimizes the space and material requirements for the sheath 26.

Most preferably, the sheath 26 is not made in a purely conical or funnel shape. Instead, the bottom portion 30 of the sheath 26 is substantially flat. This accomplishes two things. First, it makes it easier to mount the sheath 26 with or without bracket 28, on a wall or other flat surface. Second, when the scoop 10 is similarly constructed, that is, with a substantially flat bottom of shovel portion 12, the scoop 10 "self centers" so as to insure that is safely resting in the sheath 26 and cannot be accidentally removed or contaminated.

Figure 15:
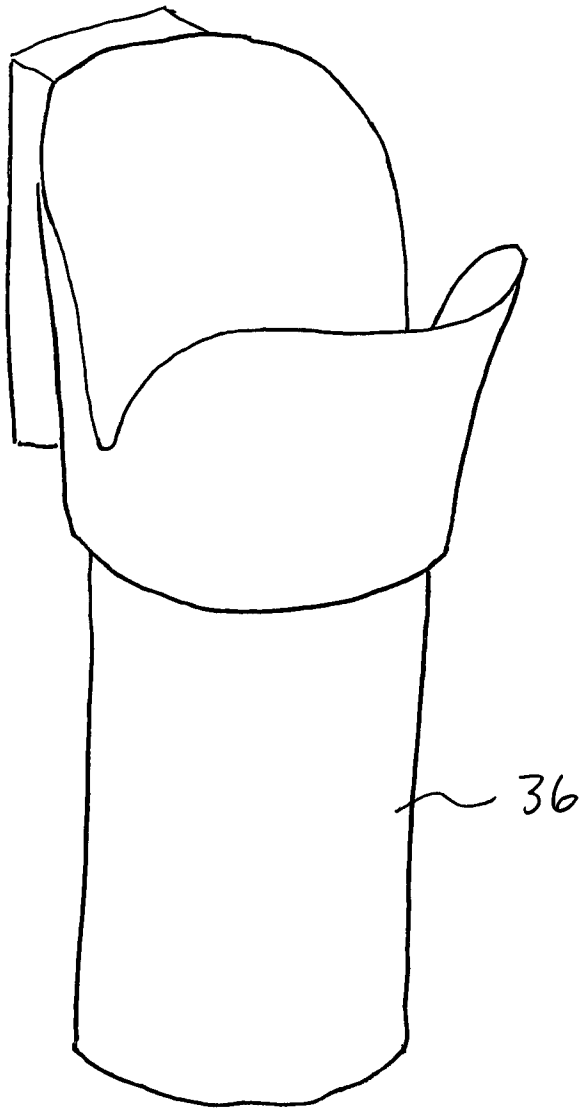
FIG. 15 is perspective view of another embodiment of a sheath in accordance with the present invention.

FIG. 15 shows an alternative sheath embodiment 36 for use with the scoop of the present invention. While such a sheath design does not minimize the space and material requirements as does the embodiment shown in FIGS. 9-11, sheath 36 functions similarly and provides additional utility by its ability to act as a material holder or transfer vessel.

In use, the scoop 10 is removed from the sheath 26 by grasping the handle 18. A user then aligns his or her hand so that his or her knuckles face the hand guard 22. Once properly grasped, the scoop is used to scoop up a quantity of material (not shown). Because of the height of the back support 14, the scoop can be filled with a significant quantity of material to be transferred. The user then carries the scooped material to the receptacle to be filled (not shown). When appropriately positioned, the scoop is tilted and the material is dispensed into the receptacle. The tapered front of the shovel portion 12 provides the ability to accurately pour the conveyed material out of the scoop into the waiting receptacle. Thereafter, the scoop 10 is returned to the sheath for the next use.

As a result of the hand guard 22 and sheath 26, the user, the material and objects in the environment do not come into contact. Thus, the present invention yields a significant improvement in the prevention of contamination.

The scoop 10 and sheath 26 of the present invention may be implemented in a variety of configurations, using certain features or aspects of the several embodiments described herein and others known in the art. Thus, although the invention has been herein shown and described in what is perceived to be the most practical and preferred embodiments, it is to be understood that the invention is not intended to be limited to the specific features and embodiments set forth above. Rather, it is recognized that modifications may be made by one of skill in the art of the invention without departing from the spirit or intent of the invention and, therefore, the invention is to be taken as including all reasonable equivalents to the subject matter disclosed herein.

The invention claimed is:

1. An apparatus for picking up material comprising:

a scooping device comprising:

a shovel portion having a front end having a curvilinear leading edge, a back end, a bottom, sides and an open top;

a back support connected to said shovel portion at said back end of said shovel portion, extending above said sides of said shovel portion to facilitate filling of said scooping device above said sides, wherein said back support is otherwise substantially co-terminus with said sides and said bottom of said shovel portion;

a handle connected to said back support and extending from the back support in a direction opposite the shovel portion;

a hand guard connected to said back support and spaced from the handle, wherein said hand guard is an elongated member having a first end connected to said back support and that extends in a direction opposite the shovel portion and a second end opposite first end and spaced from said back support, and wherein the hand guard is positioned generally below the handle; and wherein the handle is spaced from the hand guard such that the palm of a grasping hand engages the handle without the fingers of the grasping hand engaging the hand guard; and wherein the handle has an elongated body defined by a first end connected to the back support of said apparatus and a second end opposite the first end that is supported by the back support in a cantilevered fashion and wherein the body is spaced from the back support such that the grasping hand can circumferentially grasp the body without contacting the hand guard, and wherein the elongated body of the body has a first length defined between the first end and the second end that exceeds a length of the hand guard as defined between the first end and the second end of the elongated member.

2. An apparatus according to claim 1, wherein said back support is substantially round and has two sides, a shovel portion side having a face and a handle side.

3. An apparatus according to claim 2, wherein said back support includes a step in the face of said shovel portion side for increasing the carrying capacity of said apparatus.

4. An apparatus according to claim 2, wherein said back support is concave on said shovel portion side.

5. An apparatus according to claim 4, wherein said back support is convex on said handle side.

6. An apparatus according to claim 5, wherein said handle has a bottom, and is connected to the handle side of said back support at an obtuse angle as measured from the bottom of said handle to the handle side of said back support below said handle.

7. An apparatus according to claim 1, further comprising a sheath for storage of said scooping device.

8. An apparatus according to claim 7, wherein said sheath further includes a bracket for mounting the sheath on a selected surface.

9. An apparatus according to claim 7, wherein said sheath is has a substantially conical shape.

10. An apparatus according to claim 7, wherein said sheath functions as a transfer vessel.

11. A device for handling ice and food products comprising:

a scoop defined by a bottom, two sides and a back portion, wherein the bottom extends along a first plane;

a handle extending a predetermined length from said back portion in a cantilevered manner away from said scoop;

a knuckle guard located below said handle and having a length shorter than that of the handle, extending a predetermined length from said back portion away from said scoop terminating in an end portion, wherein said knuckle guard is generally arcuate in shape and wherein the handle is spaced from the knuckle guard such that the palm of a grasping hand engages the handle without the fingers of the grasping hand engaging the knuckle guard.

12. A device according to claim 11, wherein said knuckle guard narrows as it extends from said back portion toward its end portion, and wherein the scoop is larger than the hand guard.

13. A device according to claim 11, wherein the distance from a top most portion of said knuckle guard to a bottom most portion of said handle increases as said knuckle guard extends from said back portion toward its end portion.

14. A device according to claim 11, wherein the length of said handle is longer than the length of said knuckle guard.

15. A scooping device designed to scoop material from a material container, comprising:

a handle support having a shovel side and a handle side opposite the shovel side;

a handle to be engaged by a hand of a user and having a first end and a second end, the first end connected to the handle side of the handle support such that the second end is fixed in position by the connection of the first end to the handle support;

a hand guard connected to the handle side of the handle support, the hand guard having an inner surface vertically spaced from but facing the handle and an outer surface opposite the inner surface and spaced from the handle by the inner surface so as to face away from the handle so that the hand of the user, when grasping the handle, is substantially prevented from coming into contact with the material contained in the container that is adjacent the outer surface of the hand guard when the scooping device is being used to scoop material from a material container;

a shovel connected to the shovel side of the handle support, the shovel having a bottom surface and a pair of sidewalls, each sidewall having a first portion and a second portion, wherein said second portion is defined between the first portion and the handle support, and wherein the first portions and the bottom surface collectively form a first scoop portion and the second portions, the bottom surface, and the handle support collectively form a second scoop portion;

wherein the first scoop portion is configured to scoop material from the container during a substantially linear scooping action and the second portion is configured to receive the material from the first scoop portion during an at least partially upward scooping action immediately following the substantially linear scooping action; and wherein the shovel is larger than the hand guard.

* * * * *